US010006736B2

(12) United States Patent
Bartlett

(10) Patent No.: US 10,006,736 B2
(45) Date of Patent: Jun. 26, 2018

(54) GUN CLEANING KIT

(71) Applicant: Michael Bartlett, Worcestershire (GB)

(72) Inventor: Michael Bartlett, Worcestershire (GB)

( * ) Notice: Subject to any disclaimer, the term of this patent is extended or adjusted under 35 U.S.C. 154(b) by 0 days. days.

(21) Appl. No.: 15/617,600

(22) Filed: Jun. 8, 2017

(65) Prior Publication Data

US 2017/0356715 A1 Dec. 14, 2017

(30) Foreign Application Priority Data

Jun. 8, 2016 (GB) ..... 1610032.3
Jun. 16, 2016 (GB) ..... 1610501.7

(51) Int. Cl.
*F41A 31/00* (2006.01)
*F41A 29/02* (2006.01)
*B08B 9/043* (2006.01)

(52) U.S. Cl.
CPC ..... *F41A 29/02* (2013.01); *B08B 9/0436* (2013.01)

(58) Field of Classification Search
CPC ..... F41A 29/02; B08B 9/0436
USPC ..... 42/95
See application file for complete search history.

(56) References Cited

U.S. PATENT DOCUMENTS 4,674,218 A * 6/1987 Bottomley ..... F41A 29/02 15/104.05
4,899,415 A * 2/1990 Wheeler ..... F41A 29/02 15/104.05
4,901,465 A * 2/1990 Hsu ..... F41A 29/02 15/104.165
5,337,505 A * 8/1994 Brown ..... F41A 29/02 15/104.165
5,557,871 A * 9/1996 Lalonde ..... A46B 3/18 15/104.165
5,934,000 A * 8/1999 Hayes, Sr. ..... F41A 29/02 15/104.2
6,378,236 B1 * 4/2002 Solberg ..... F41A 29/02 15/104.165
8,572,883 B2 * 11/2013 Markle ..... F41A 29/02 15/104.062
9,683,804 B2 * 6/2017 Hartness ..... F41A 29/02
2006/0010753 A1 * 1/2006 Buie ..... F41A 29/02 42/95
2006/0236584 A1 * 10/2006 Williams ..... F41A 29/00 42/95

(Continued)

OTHER PUBLICATIONS

Search Report issued in Foreign Priority Application Serial No. 1610032.3 dated Jul. 25, 2016.

*Primary Examiner* — Samir Abdosh
(74) *Attorney, Agent, or Firm* — Haugen Law Firm PLLP

(57) ABSTRACT

A gun cleaning kit comprising a handle, an elongate rod, a cylindrical brush comprising radially outwardly projecting metal bristles and a cylindrical wiping element, wherein the handle defines a first part of a two-part coupling and a first end of the rod defines a second part of the two-part coupling such that the handle is capable of being detachably coupled to the first end of the rod via the first two-part coupling; a second end of the rod defines a first part of a second two-part coupling; and each of the cylindrical brush and cylindrical wiping element defines a second part of the second two-part coupling, such that the cylindrical brush and the cylindrical wiping element are each separately capable of being detachably coupled to the second end of the rod via the second two-part coupling.

14 Claims, 4 Drawing Sheets

(56) References Cited

U.S. PATENT DOCUMENTS

| | | | | |
|---|---|---|---|---|
| 2006/0277811 | A1* | 12/2006 | Peterson | F41A 29/02 42/95 |
| 2009/0145785 | A1* | 6/2009 | Garrett | A45C 11/00 206/223 |
| 2010/0175296 | A1* | 7/2010 | Williams | F41A 29/02 42/95 |
| 2011/0168207 | A1* | 7/2011 | Smith | A46B 3/18 134/8 |
| 2012/0198639 | A1* | 8/2012 | Smith | A46B 3/18 15/104.05 |
| 2013/0032501 | A1* | 2/2013 | Williams | F41A 29/02 206/361 |
| 2013/0097794 | A1* | 4/2013 | Brown | F41A 29/02 15/143.1 |
| 2013/0283658 | A1* | 10/2013 | Buie, II | F41A 29/02 42/95 |
| 2013/0291421 | A1* | 11/2013 | Williams | F41A 29/02 42/95 |
| 2014/0338701 | A1* | 11/2014 | Freytag | F41A 29/02 134/8 |
| 2015/0097094 | A1* | 4/2015 | Hartness | F41A 23/18 248/126 |
| 2017/0350671 | A1* | 12/2017 | Larue | F41A 29/02 |

* cited by examiner

GUN CLEANING KIT

The present invention relates to a gun cleaning kit, in particular for use with shotguns and other weapons which include a relatively long barrel.

It is very important to maintain firearms in a clean and serviceable condition and this includes cleaning the barrel or barrels regularly after use to prevent the build-up of debris within the barrel.

Many cleaning products are available for firearms, but these generally are not capable of completing all of the desired cleaning tasks. The user typically needs to purchase multiple cleaning products to complete the cleaning tasks.

According to a first aspect of the present invention, there is provided a gun cleaning kit comprising a handle, an elongate rod, a cylindrical brush comprising radially outwardly projecting metal bristles and a cylindrical wiping element, wherein the handle defines a first part of a two-part coupling and a first end of the rod defines a second part of the two-part coupling such that the handle is capable of being detachably coupled to the first end of the rod via the first two-part coupling; a second end of the rod defines a first part of a second two-part coupling; and each of the cylindrical brush and cylindrical wiping element defines a second part of the second two-part coupling, such that the cylindrical brush and the cylindrical wiping element are each separately capable of being detachably coupled to the second end of the rod via the second two-part coupling.

According to the invention, a user is able to couple together the handle, the elongate rod and one of the two cleaning tools (the cylindrical brush or the cylindrical wiping element) to form a desired cleaning product. For example, the user may attach the elongate rod to the handle and then attach the cylindrical brush to the distal end of the rod (i.e. the end of the rod furthest from the handle) to initially clean the or each barrel of the gun. The cylindrical brush may then be removed from the rod and replaced with the cylindrical wiping element, which is able to remove the debris dislodged by the brush and optionally also to oil the inside of the barrel or barrels.

Alternatively, the user may omit the elongate rod and couple the handle directly to the cleaning brush or the wiping element, for example to clean the chokes of a shotgun. Thus, the first two-part coupling may correspond to (i.e. be substantially identical to) the second two-part coupling, whereby, a first part of the first two-part coupling may be connected to a second part of either the first two-part coupling or the second two-part coupling.

The cylindrical wiping element may be in the form of a cylindrical cleaning pad which comprises outwardly extending polymeric fibres or it may be in the form of a cylindrical body which defines a slot configured to receive therein a separate cloth component. The cylindrical cleaning pad may be used for guns having a larger diameter barrel, such as shotguns and the cylindrical body including a slot for a cloth may be used for guns having a smaller diameter barrel, such as rifles.

In an embodiment of the invention, the cylindrical wiping element may define a first part of the second two-part coupling at a distal end thereof. Thus, the cylindrical wiping element may define the second part of the second two-part coupling at a proximal end thereof and further defines a first part of the second two-part coupling at the distal end thereof. In this way, the cylindrical wiping element may be secured to the elongate rod at its proximal end and the cylindrical brush may be secured to the distal end of the cylindrical wiping element. Accordingly, the cleaning apparatus may be arranged: handle-elongate rod-cylindrical wiping element-cylindrical cleaning brush or handle-cylindrical wiping element-cylindrical cleaning brush. In this way, the firearm may be cleaned via a single cleaning action.

In a further embodiment of the invention, the elongate rod may be padded to prevent any damage to the interior barrel surface by inadvertent contact with the elongate rod. The rod may be padded with a cleaning material. The cleaning material used as padding for the elongate rod (in embodiments in which the elongate rod is padded) may be the same or different to the cleaning material which forms part of or is used with the cylindrical wiping element. Accordingly, in an embodiment of the invention, the kit comprises a first cylindrical cleaning pad (i.e. a padded elongate rod) and a second cylindrical cleaning pad.

In an embodiment of the invention, the handle further defines a front face which faces towards the rod in use, the front face carrying or defining a protective polymeric element. The protective polymeric element carried by or defined by the front face of the handle prevents damage to the barrel or other parts of the gun in the event that the handle contacts the end of the barrel of other components of the gun in use. Thus, in embodiments in which the handle is formed from a metal, such as aluminium or steel, the front face of the handle carries a protective polymeric element, for example in the form of a polymeric bush secured to the front face of the handle. In such embodiments, the polymeric bush may be detachably coupled to the handle. The polymeric bush may be formed from nylon or PTFE, for example. Alternatively, in embodiments in which the handle is formed from a polymeric material, such as for example, nylon or PTFE, the front face of the handle may define a protective polymeric element. A separate polymeric protective element may be used with a polymeric handle if desired.

In an embodiment of the invention, the first two-part coupling and/or the second two-part coupling is a threaded coupling. Suitably both the first two-part coupling and the second two-part coupling are threaded couplings. Thus, each part of the two part coupling comprises a threaded shaft or a complimentary threaded bore. In this embodiment the handle may be screwed onto the proximal end of the rod and the relevant cleaning tool may be screwed onto the distal end of the rod. Such an arrangement allows for quick and easy assembly and disassembly of the desired cleaning tool.

The first part of the first and second threaded coupling may be compatible with the second part of the first and second threaded couplings. Accordingly the first part of the first threaded coupling may be coupled to the second part of either the first or the second threaded coupling.

The cleaning kit may include a second elongate rod, wherein the second elongate rod defines one part of a two-part coupling at each end thereof, such that the second rod may be connected to either end of the first elongate rod. The second elongate rod may be used to increase the spacing between the handle and the respective cleaning tool, e.g. for long barrels. Additionally or alternatively, the second rod may provide additional functionality to the cleaning tool. For example, the second elongate rod may be multi-faceted. Thus, it may comprise a body having a triangular, square, rectangular, pentagonal, hexagonal or other geometric shape cross-section. In this way, the second rod may replace the handle and may be located within the chuck of a rotatable device, such as a drill. This allows the first rod, the second rod and the respective cleaning tool to be rotated by the drill (or other rotating device) while cleaning the barrel of the gun.

A cleaning kit which includes a second elongate rod may be arranged in multiple configurations as follows:

Handle-cleaning brush;

Handle-cylindrical wiping element;

Handle-cylindrical wiping element-cleaning brush;

Handle-first elongate rod-cleaning brush;

Handle-first elongate rod-cylindrical wiping element;

Handle-first elongate rod-cylindrical wiping element-cleaning brush;

Handle-second elongate rod-cleaning brush;

Handle-second elongate rod-cylindrical wiping element;

Handle-second elongate rod-cylindrical wiping element-cleaning brush;

Handle-first elongate rod-second elongate rod-cleaning brush;

Handle-first elongate rod-second elongate rod-cylindrical wiping element;

Handle-first elongate rod-second elongate rod-cylindrical wiping element-cleaning brush;

Handle-second elongate rod-first elongate rod-cleaning brush;

Handle-second elongate rod-first elongate rod-cylindrical wiping element;

Handle-second elongate rod-first elongate rod-cylindrical wiping element-cleaning brush;

Second elongate rod-cleaning brush;

Second elongate rod-cylindrical wiping element;

Second elongate rod-cylindrical wiping element-cleaning brush;

Second elongate rod-first elongate rod-cleaning brush;

Second elongate rod-first elongate rod-cylindrical wiping element; and

Second elongate rod-first elongate rod-cylindrical wiping element-cleaning brush.

In view of the above, the term "handle" may be defined as either a user-operable component or a rotational device-operable component. In other words, the handle may be adapted for operation by a user or it may be adapted for operation by a rotational device, such as a drill. Accordingly, the handle may be adapted or configured for engagement with jaws of a rotational device. It will thus be appreciated that in certain embodiments, the second elongate rod may form the handle.

It has been found that copper-bristled brushes perform well when cleaning the barrels of guns. The copper bristles are sufficiently stiff that they are able to dislodge stubborn debris, but not too stiff that they damage the interior surface of the barrel. Accordingly, the bristles of the cylindrical brush may be formed from copper. Other metals or alloys, such as phosphor bronze, may be used to form the bristles of the brush.

It has further been found that a helical arrangement of the bristles of the cylindrical brush aid the transportation of the debris out of the barrel. Therefore, the metal bristles of the cylindrical brush are suitably arranged as a helical array about a central core.

It will be appreciated from the foregoing that the term "cylindrical" in the context of the brush is intended to mean that the brush has a longitudinal axis and when viewed along that axis, the bristles extend radially outwards around the entire axis (i.e. 360° around the axis) and the bristles have substantially the same length.

The cylindrical wiping element suitably also includes an elongate rigid core which may support outwardly extending polymeric fibres or which may define a slot. The polymeric fibres may be formed from a natural material, such as cotton or from a synthetic polymeric material. The fibres are relatively soft and may be formed from microfibers. The fibres may form radially outwardly extending "fingers", wherein the fingers are readily deformable. The fibres may be absorbent or together they may form an absorbent pad.

In embodiments in which the cylindrical wiping element defines a slot, the slot may be a longitudinal slot.

In an embodiment of the invention, the central core of the cylindrical brush and/or the elongate rigid core of the cylindrical wiping element carries or defines the second part of the second two-part coupling. Suitably both the central core of the cylindrical brush and the elongate rigid core of the cylindrical wiping element carries or defines the second part of the second two-part coupling. The second part of the second two-part coupling is suitably a threaded portion selected from a threaded bore and a threaded shaft.

The skilled person will appreciate that the features described and defined in connection with the aspect of the invention and the embodiments thereof may be combined in any combination, regardless of whether the specific combination is expressly mentioned herein. Thus, all such combinations are considered to be made available to the skilled person.

An embodiment of the invention will now be described, by way of example only, with reference to the accompanying drawings in which.

For the avoidance of doubt, the skilled person will appreciate that in this specification, the terms "up", "down", "front", "rear", "upper", "lower", "width", etc. refer to the orientation of the components as found in the example when installed for normal use as shown in the Figures.

Figure 1:
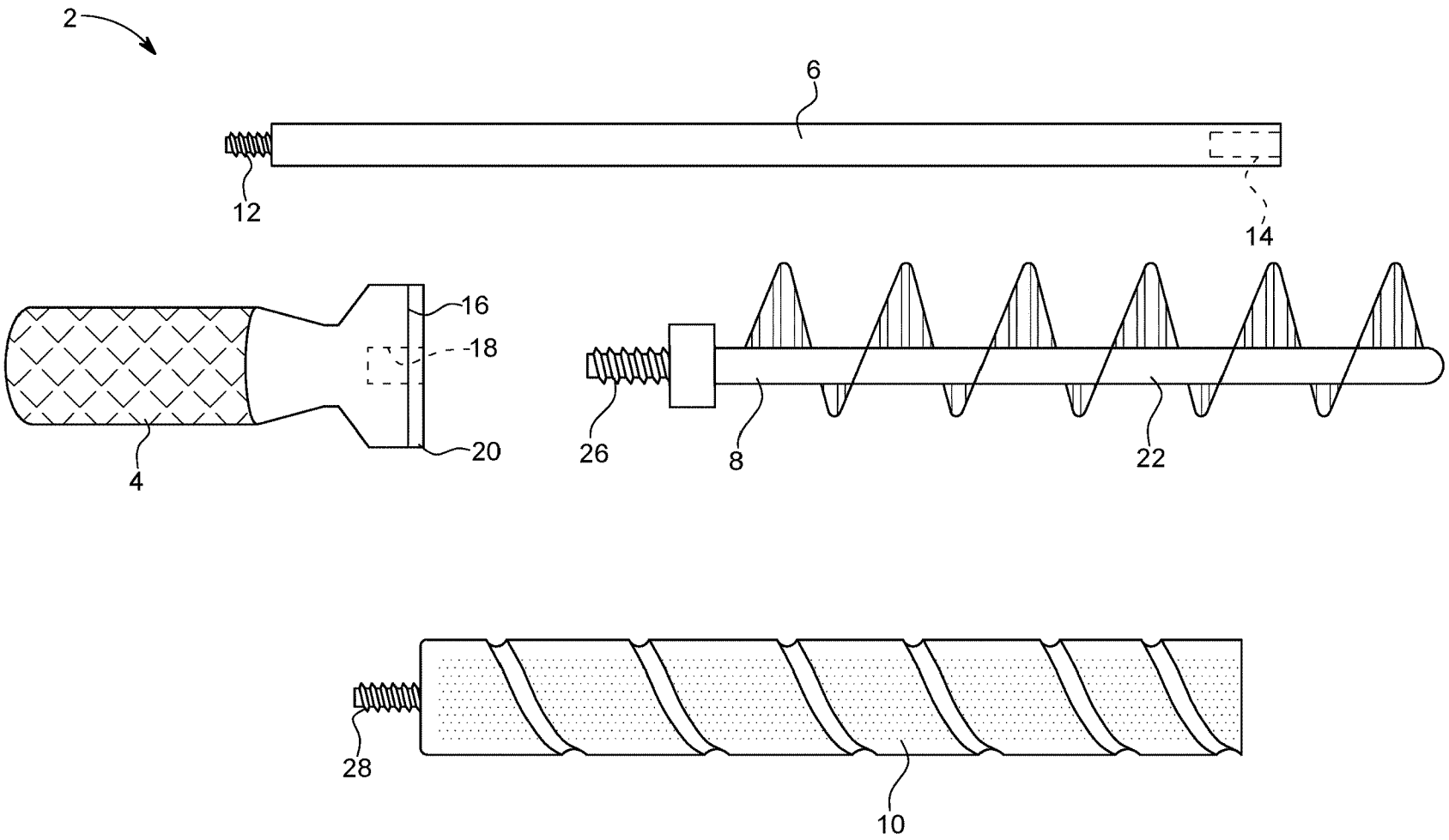
FIG. 1 shows a gun cleaning kit according to the first aspect of the invention.

FIG. 1 shows an embodiment of a gun cleaning kit 2 according to the invention. The kit 2 comprises a handle 4, an elongate aluminium rod 6, a cylindrical brush 8 having copper bristles and a cylindrical wiping element in the form of a cylindrical cleaning pad 10.

The rod 6 defines at its first end a threaded shaft 12 and at its opposite end a threaded bore 14. The handle 4 defines a front face 16 within which is defined a threaded bore 18 configured to receive therein in threaded engagement the threaded shaft 12 of the rod 6.

The front face 16 of the handle 4 also carries a PTFE (polytetrafluorethylene) bush 20 (shown in more detail on FIG. 5) which acts as a protective polymeric element. The PTFE bush 20 is located within an annular recess (not shown) defined by the front face 16 of the handle 4 and secured by adhesive.

The cylindrical brush and the cylindrical cleaning pad both include an elongate rigid core 22, 24. Located at one end of each of the elongate rigid cores 22, 24 is a threaded shaft 26, 28. Each of the threaded shafts 26, 28 are configured to form separately a threaded engagement within the threaded bore 14 of the rod 6. The distal end of the elongate rigid core 24 of the cleaning pad 10 defines a threaded bore therein. The threaded bore at the distal end of the rigid core 24 is configured to threadedly receive therein the threaded shaft 26 of the rigid core 22.

Figure 2:
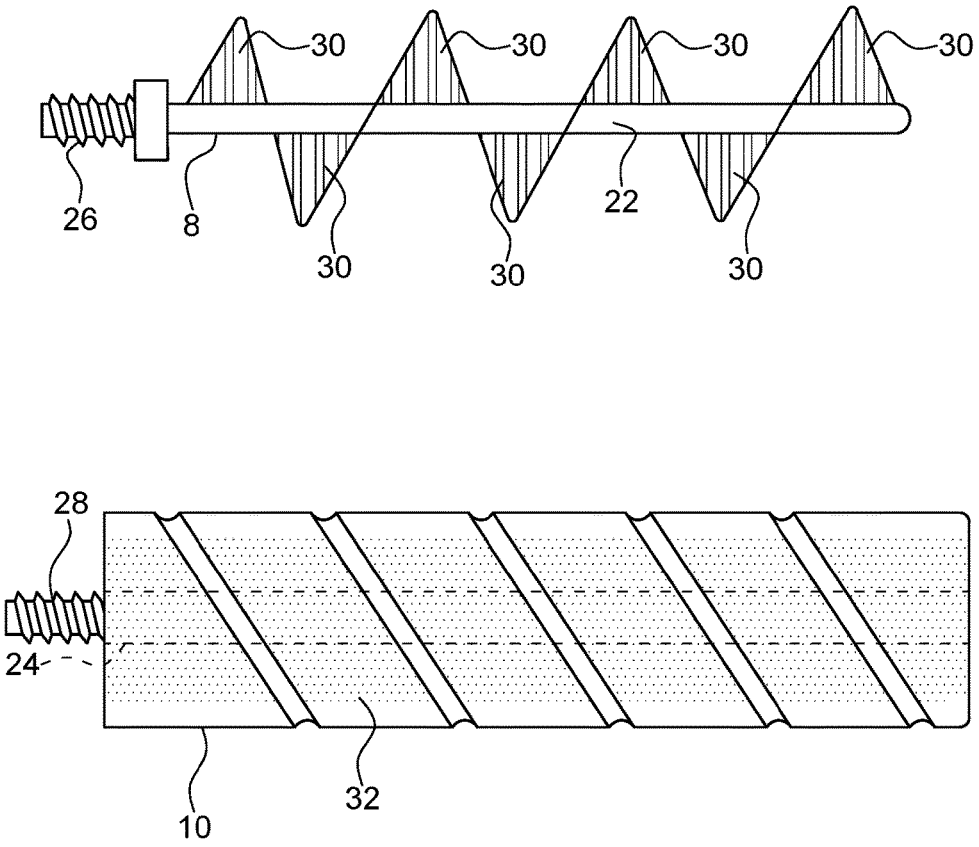
FIG. 2 shows the cylindrical brush and the cylindrical cleaning pad of the apparatus shown in FIG. 1.

FIG. 2 shows the cylindrical brush 8 and the cylindrical cleaning pad 10 in more detail. As can be seen, the cylindrical brush 8 comprises a plurality of copper bristles 30 extending radially outwards from the core 22. The bristles 30 have substantially the same length and are arranged in a helical array along the axial length of the core 22.

The cylindrical cleaning pad 10 has a strip 32 of polymeric fibres wrapped helically around the rigid core 24. The strip 32 comprises a fabric backing sheet (not shown) from which extends outwardly a plurality of fingers formed from the polymeric fibres. The fabric backing sheet is adhered to the rigid core 24 such that the fingers extend outwardly from the core 24.

Figure 3:
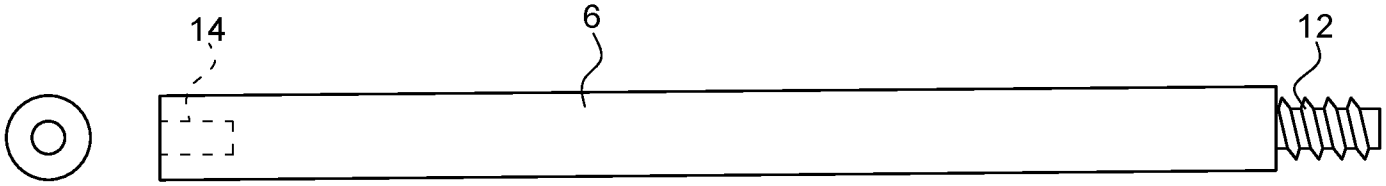
FIG. 3 is a cross-sectional view through the elongate rod of the apparatus shown in FIG. 1.

FIG. 3 shows a cross-section through the rod in which the threaded shaft 12 and the threaded bore 14 can be seen in more detail.

Figure 4:
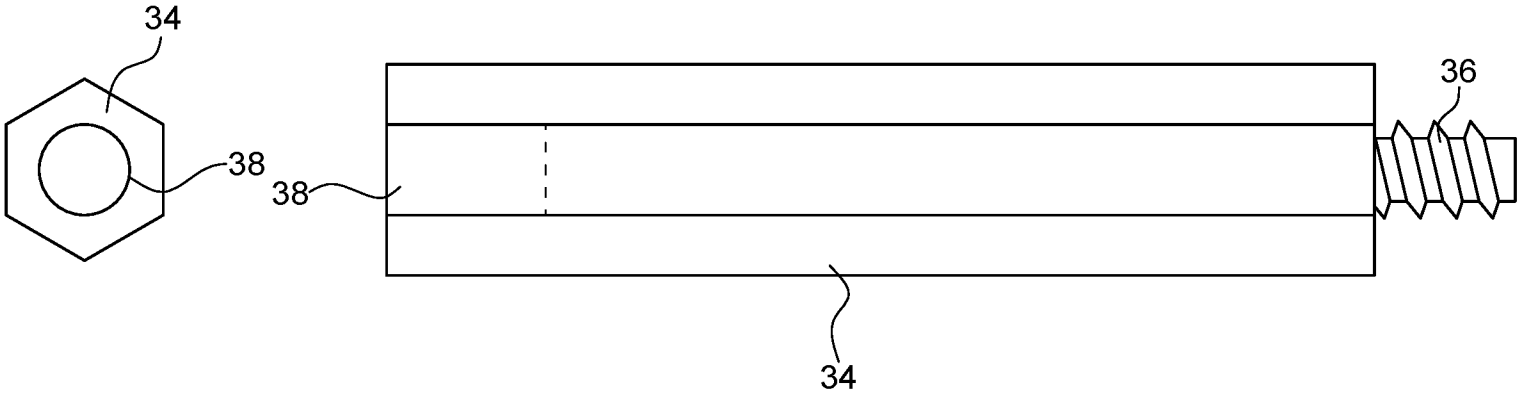
FIG. 4 is a cross-sectional view of an optional second rod that may form part of the kit show in FIG. 1.

FIG. 4 shows an optional component, namely a second elongate rod 34 that is not shown in FIG. 1. The second elongate rod 34 is also made from aluminium, but is shorter than the first elongate rod 6. The second elongate rod 34 has a hexagonal cross-section and also defines a threaded shaft 36 at one end and a threaded bore 38 at the other end. The threaded shaft 36 and the threaded bore 38 have the same configuration as the corresponding shaft 12 and bore 14 of the first rod 6. In this way, the shafts are interchangeable and can also be coupled together with the threaded shaft of one being threadedly engaged with the threaded bore of the other. This allows the length of the first rod 6 to be extended. The hexagonal cross-section allows the second elongate rod 34 to be gripped by the jaws (e.g. chuck) of an electric drill and the drill may cause the second elongate rod 34, and any cleaning tool 8, 10 attached thereto, to rotate. Where the second elongate rod 34 is caused to rotate by a separate rotational device, such as an electric drill, the second elongate rod 34 is considered to be the handle in the context of the present invention.

Figure 5:
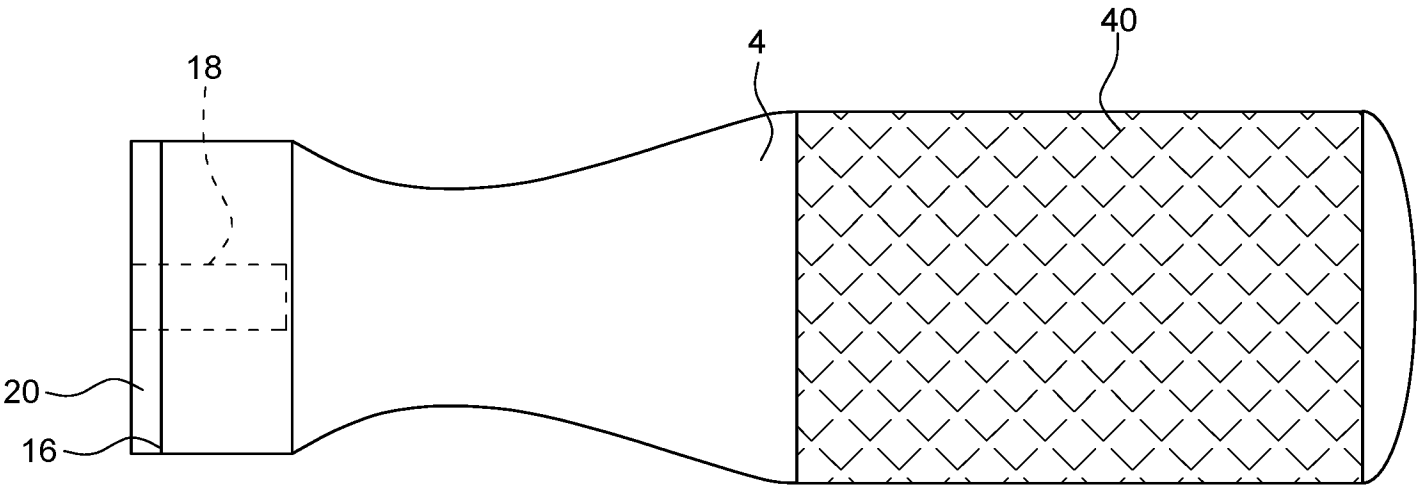
FIG. 5 is a perspective view of the handle which forms a part of the apparatus shown in FIG. 1.

FIG. 5 shows the handle 4 in more detail. As noted above, the handle 4 is formed from aluminium and defines a gripping portion 40 having a knurled surface. The PTFE bush 20 protects the end of the barrel being cleaned against damage by the handle and the threaded bore 18 is adapted to receive any of the threaded shafts discussed hereinabove, namely the threaded shaft 12 of the rod 6, the threaded shaft 26 of the cylindrical brush 8, the threaded shaft 28 of the cleaning pad 10 or the threaded shaft 36 of the second, hexagonal rod 34.

In use, the user threadedly couples the handle 4 to the rod 6 and then selects the desired cleaning tool, for example, the cylindrical brush 8. The barrel of the gun may then be cleaned with the cylindrical brush 8. After cleaning with the brush 8, the user may remove the brush 8 from the rod and connect in its place the cylindrical cleaning pad 10. This may be used to remove the debris from the barrel that was loosened by the brush 8. A suitable gun oil may be applied to the cylindrical cleaning pad 10 to provide a protective coating of oil to the inside of the barrel.

Alternatively, the user threadedly couples the handle 4 to the rod 6, threadedly couples the cylindrical cleaning pad 10 to the distal end of the rod 6, and then threadedly couples the cylindrical brush 8 to the distal end of the cleaning pad 10. The barrel may be cleaned in a single process using the kit in this configuration.

While cleaning, the PTFE bush 20 protects the ends of the barrel(s) from damage by the handle, should the handle contact the ends of the barrel during cleaning.

Should the user desire a longer cleaning apparatus, the second rod 34 may be located between the handle and the first rod 6 or between the first rod 6 and the desired cleaning tool. As the second rod 34 includes corresponding threaded portions at either end to the first rod 6, the combined rods 6, 34 would retain a threaded shaft at one end and a threaded bore at the opposite end to which the handle 4 and the respective cleaning tool 8, 10 are secured.

Alternatively, if the user wishes to use a mechanical tool to assist with the cleaning process, the user may connect the second rod 34 to the proximal end of the first rod 6 and a desired cleaning tool 8, 10 to the distal end of the first rod 6. The hexagonal second rod 34 may then be located within the chuck of a suitable mechanical tool, such as a drill, which rotates the second rod 34. This in turn rotates the first rod 6 and the respective cleaning tool 8, 10.

The invention claimed is:

1. A gun cleaning kit comprising a handle, an elongate rod that is padded along its length, a cylindrical brush comprising radially outwardly projecting metal bristles, and a cylindrical wiping element, wherein the handle defines a first part of a two-part coupling and a first end of the rod defines a second part of the two-part coupling such that the handle is capable of being detachably coupled to the first end of the rod via the first two-part coupling; a second end of the rod defines a first part of a second two-part coupling; and each of the cylindrical brush and cylindrical wiping element defines a second part of the second two-part coupling, such that the cylindrical brush and the cylindrical wiping element are each separately capable of being detachably coupled to the second end of the rod via the second two-part coupling.

2. A gun cleaning kit according to claim 1, wherein the first two-part coupling and/or the second two-part coupling is a threaded coupling.

3. A gun cleaning kit according to claim 1, wherein the cylindrical wiping element includes a central core which defines the second part of the second two-part coupling at a proximal end thereof and further defines a first part of the second two-part coupling at a distal end thereof.

4. A gun cleaning kit according to claim 1, wherein the metal bristles of the cylindrical brush are formed from copper.

5. A gun cleaning kit according to claim 1, wherein the metal bristles of the cylindrical brush are arranged as a helical array about a central core.

6. A gun cleaning kit according to claim 1, wherein the cylindrical brush includes a central core and the central core carries or defines the second part of the second two-part coupling.

7. A gun cleaning kit according to claim 1, wherein the kit further includes a second elongate rod, wherein the second elongate rod defines one part of a two-part coupling at each end thereof, such that the second rod may be connected to either end of the first elongate rod.

8. A gun cleaning kit according to claim 7, wherein the second elongate rod defines a multi-faceted surface.

9. A gun cleaning kit according to claim 8, wherein the second rod comprises a body having a triangular, square, rectangular, pentagonal or hexagonal cross-section.

10. A gun cleaning kit according to claim 1, wherein the handle further defines a front face which faces towards the rod in use and the front face carries or defines a protective polymeric element.

11. A gun cleaning kit according to claim 10, wherein the polymeric element is a bush which is formed from polytetrafluoroethylene (PTFE) or nylon.

12. A gun cleaning kit according to claim 1, wherein the handle is a second elongate rod.

13. A gun cleaning kit according to claim 12, wherein the second elongate rod defines a multi-faceted surface.

14. A gun cleaning kit according to claim 13, wherein the second elongate rod comprises a body having a triangular, square, rectangular, pentagonal or hexagonal cross-section.

* * * * *